US008523713B2

(12) United States Patent
Román

(10) Patent No.: US 8,523,713 B2
(45) Date of Patent: Sep. 3, 2013

(54) LEG GLOVES WITH DOWNWARD DIAGONAL FACING POCKET OPENINGS

(76) Inventor: Kendyl A. Román, Sunnyvale, CA (US)

( * ) Notice: Subject to any disclaimer, the term of this patent is extended or adjusted under 35 U.S.C. 154(b) by 0 days.

(21) Appl. No.: 12/853,237

(22) Filed: Aug. 9, 2010

(65) Prior Publication Data

US 2010/0304899 A1 Dec. 2, 2010

Related U.S. Application Data

(63) Continuation-in-part of application No. 11/899,529, filed on Sep. 6, 2007, now abandoned, which is a continuation-in-part of application No. 11/800,356, filed on May 4, 2007, now abandoned, which is a continuation-in-part of application No. 11/499,023, filed on Aug. 3, 2006, now abandoned.

(51) Int. Cl.
*A63B 69/00* (2006.01)

(52) U.S. Cl.
USPC ..... 473/438; 473/450; 473/458

(58) Field of Classification Search
USPC ..... 473/212–214, 217, 450, 458, 464, 473/438; 2/16, 468, 22, 24, 59, 60, 62, 66, 2/158–160, 161.1, 161.2, 162, 208, 308, 2/309, 303, 900; 36/1.5, 2 R; 150/154; 602/4–6, 26, 27, 60, 63; D2/206, 900, 610–615; D29/120.1, 113, 123, 118; 128/892
See application file for complete search history.

(56) References Cited

U.S. PATENT DOCUMENTS

| | | | | | |
|---|---|---|---|---|---|
| 926,402 | A | * | 6/1909 | Geissler | 2/239 |
| 1,382,446 | A | * | 6/1921 | Warren | 2/311 |
| 2,122,627 | A | * | 7/1938 | Sternberg | 2/24 |
| 2,188,718 | A | * | 1/1940 | Jung | 2/24 |
| 2,321,091 | A | * | 6/1943 | Kertesz et al. | 2/159 |
| 2,552,177 | A | * | 5/1951 | Hurt | 2/24 |
| 2,671,904 | A | * | 3/1954 | Stroh | 2/311 |
| 2,748,397 | A | * | 6/1956 | Stolzenberg | 2/240 |
| 3,189,919 | A | * | 6/1965 | Chase | 2/16 |
| 3,633,290 | A | * | 1/1972 | Rubeling | 36/2 R |
| 3,670,933 | A | * | 6/1972 | Jones | 224/222 |
| 3,934,583 | A | * | 1/1976 | Hollingshead et al. | 602/62 |
| 4,341,331 | A | * | 7/1982 | McDougall | 224/219 |
| 4,408,355 | A | * | 10/1983 | Brock | 2/66 |
| D273,331 | S | * | 4/1984 | Gruber | D24/190 |
| 4,461,030 | A | * | 7/1984 | Knudsen | 224/222 |
| 4,462,116 | A | * | 7/1984 | Sanzone et al. | 2/170 |
| 4,492,227 | A | * | 1/1985 | Senn et al. | 602/63 |
| 4,579,265 | A | * | 4/1986 | Schiller | 224/682 |
| 4,625,340 | A | * | 12/1986 | Hernandez | 2/247 |
| 4,771,553 | A | * | 9/1988 | Smithdeal | 36/1 |
| 4,893,357 | A | * | 1/1990 | Evans | 2/208 |
| 4,913,326 | A | * | 4/1990 | Echelson | 224/222 |

(Continued)

FOREIGN PATENT DOCUMENTS

DE 3242145 A1 * 5/1984

*Primary Examiner* — Mitra Aryanpour

(57) ABSTRACT

A leg glove having downward facing diagonal pockets for lifting a person who is jumping or being lifted, especially for lineouts in Rugby Union. A single piece of flexible, elastic material has a base layer formed in a conical section and a partially overlapping pocket layer that is folded back over the base layer and attached to form a pocket between the base layer and the pocket layer.

12 Claims, 10 Drawing Sheets

(56) References Cited

U.S. PATENT DOCUMENTS

| | | | | | |
|---|---|---|---|---|---|
| 5,016,621 | A | * | 5/1991 | Bender | 602/26 |
| 5,070,544 | A | * | 12/1991 | Aliberti et al. | 2/170 |
| 5,168,577 | A | * | 12/1992 | Detty | 2/16 |
| D335,023 | S | * | 4/1993 | Hutcheson | D2/612 |
| D354,840 | S | * | 1/1995 | Geisler | D2/612 |
| D365,677 | S | * | 1/1996 | Dolsey | D3/226 |
| 5,671,481 | A | * | 9/1997 | Giard | 2/170 |
| 5,817,038 | A | * | 10/1998 | Orange et al. | 602/3 |
| 5,890,224 | A | * | 4/1999 | Clark | 2/22 |
| D416,651 | S | * | 11/1999 | Lanoue | D29/120.1 |
| 6,063,048 | A | * | 5/2000 | Bodenschatz et al. | 602/62 |
| 6,301,803 | B1 | * | 10/2001 | Patterson | 36/2 R |
| 6,325,260 | B1 | * | 12/2001 | Gorham | 224/222 |
| 6,425,137 | B1 | * | 7/2002 | Fakhrai | 2/170 |
| 6,443,341 | B1 | * | 9/2002 | Rittmann | 224/219 |
| D569,577 | S | * | 5/2008 | Barker | D2/614 |
| D594,604 | S | * | 6/2009 | Roman | D29/120.1 |
| D598,642 | S | * | 8/2009 | Plumert | D2/976 |
| 7,865,970 | B2 | * | 1/2011 | Giacheri | 2/22 |
| 2004/0173648 | A1 | * | 9/2004 | Avazpour et al. | 224/219 |
| 2004/0211798 | A1 | * | 10/2004 | Schechter | 224/222 |
| 2005/0193476 | A1 | * | 9/2005 | Chinn | 2/247 |
| 2010/0059559 | A1 | * | 3/2010 | Given | 224/222 |

* cited by examiner

PRIOR ART

LEG GLOVES WITH DOWNWARD DIAGONAL FACING POCKET OPENINGS

RELATED APPLICATIONS

This application is a continuation-in-part of, and claims priority based on, U.S. patent application Ser. No. 11/899,529, filed Sep. 6, 2007, now abandoned which is a continuation-in-part of, and claims priority based on, U.S. patent application Ser. No. 11/800,356, filed May 4, 2007 now abandoned, which is a continuation-in-part of, and claims priority based on, U.S. patent application Ser. No. 11/499,023, filed Aug. 3, 2006 now abandoned.

U.S. Pat. No. D594,604 was issued Jun. 16, 2009, based on U.S. patent application Ser. No. 29/307,510, filed Apr. 23, 2008. U.S. Pat. No. D594,604 disclosed a design for an embodiment for a leg glove, and is included herein by reference.

BACKGROUND

1. Field of the Invention

This invention relates to a leg glove, especially a leg device, such as a leg glove or leg mitten, with pockets for the hands of a lifter used when lifting a person who is jumping or being lifted, for example a jumper in a Rugby lineout. The leg glove pockets have downward diagonal facing pocket openings.

2. Description of Prior Art

There is a need to jump high in order to intercept a ball in many sports, such as Rugby, volleyball, or baseball.

For example, in Rugby Union, when a ball goes out of bounds it is returned to play using a set formation known as a lineout. In a lineout, players from both teams line up near where the ball went out of bounds. Each team forms its own line. A space of about one yard is formed between the lines of players, referred to as the tunnel. The ball is then thrown back into the playing field. The ball must be thrown straight into the middle of the tunnel. Players compete for the ball. A player has a greater likelihood of winning the ball if he is higher in the air than others. Therefore, players jump and/or are lifted up by teammates to be in a favorable position to win possession of the ball.

Other activities such as ice skating and dancing also involve lifts.

Various methods have been employed to accomplish these types of lifts and jumps.

Originally, players jumped unassisted by teammates, but the rules of Rugby Union have changed to allow teammates to support a player while in the air. At first, lifters would grab the waist of the jumper. It is currently illegal to grab on to or bind to the player while the player is on the ground. As time passed, it became common to support a jumping player by grabbing the player by the bottom of the shorts and lifting him/her by the shorts long enough to play the ball. More recently, it has been made legal to grab the jumping player by the thighs above the knee. Many jumping players wrap a combination of materials and tapes around the thigh to offer those lifting a better grip.

The use of such techniques has several disadvantages such as:

- Being ineffective, as a good grip is often still difficult to maintain
- Being unsafe, as jumping players that are dropped because of poor grip can fall up to 10 feet and land in an awkward position
- Damage to or tearing of clothing, especially if the proper shorts are not worn

- Extreme discomfort to the jumper
- Taking time to apply during the critical stages of pre-match preparation
- Requiring help to apply, as taping one's own leg is often difficult to do satisfactorily
- Needing to be taped before every game
- Requiring special skill of the lifter in the case where only one lifter is used It is also desirable to have a means for lifting that does not cause additional bunching and riding up of the short rugby shorts and that looks better than an awkward contraption of tapes on both thighs.

More recently, elastic sleeves with a gripping surface have also been placed around legs or knees. One example is disclosed in U.S. patent application Ser. No. 11/255,399 ("Giacheri"). These also have several disadvantages such as:

- Being constricting during the activity between lifts
- Being too elastic and sliding up during lifts
- Being hot, causing excessive sweating and odor
- Having material break down
- Being relatively heavy
- Expensive materials requiring expensive equipment to manufacture Rugby shorts have been modified to have baggy grasping material. For example, French patent application publication 2,754,679 A ("Rous"), filed Oct. 22, 1996, 24, attempts to improve the lineout lift by adding baggy or puffy grasping material to the front of regulation non-stretch cotton fabric shorts. Rous discloses three embodiments: 1) a baggy pouch sewn on all sides; 2) puffy shapes, cut into the fabric, which extends out like riding breeches; and 3) a false skirt canopy, sewn vertically into both side seams and held open with a strap which has each end sewn to the fabric of the shorts leg. These have similar disadvantages such as:

- Being too loose and sliding up during lifts
- Sliding up to the groin during the lift, rather than remaining on the lower thigh
- Not being removable, separate from the shorts, for use by other players during the same game There is a need for a means to improve lifting in all levels of play, as ineffective lifts can be costly, dangerous, and contribute significantly to losing a game.

What is needed is an improved lightweight, low cost, easy to manufacture, quick, simple, easy to use, reusable leg glove that provides an effective means of obtaining a sure grip that offers comfort and safety to the players involved.

SUMMARY OF THE INVENTION

Accordingly, it is an objective of the present invention to provide an improved lightweight, low cost, easy to manufacture, quick, easy to use, simple, reusable, effective means of lifting a jumper that provides safety and comfort to those involved.

OBJECTS AND ADVANTAGES

Accordingly, beside the objects and advantages described above, some additional objects and advantages of the present invention are:

1. To provide a comfortable method of lifting a player who is jumping.
2. To provide a more effective method of obtaining a sure grip on the thighs of a jumping player.
3. To provide an increase of safety for a jumping player being lifted by the thighs.

4. To provide means and methods of lifting that are easy to use.
5. To provide means and methods of lifting that are reusable.
6. To provide means and methods of lifting that offer higher performance.
7. To provide means and methods of lifting that can be quickly applied and removed.
8. To provide means and methods of lifting that are adjustable to varying conditions.
9. To empower a less skilled lifter to lift a jumper by himself.
10. To provide means and methods of lifting that are minimal in cost and waste.
11. To provide means and methods of lifting that do not worsen a user's appearance.
12. To provide means and methods of lifting that do not interfere with the wearing of compression shorts.
13. To provide means and methods of lifting that improve a user's appearance.
14. To provide means of lifting that do not stretch and slide up the jumper's leg during the lift.

DRAWING FIGURES

In the drawings, closely related figures have the same number but different alphabetic suffixes.

REFERENCE NUMERALS IN DRAWINGS

Figure 1A:
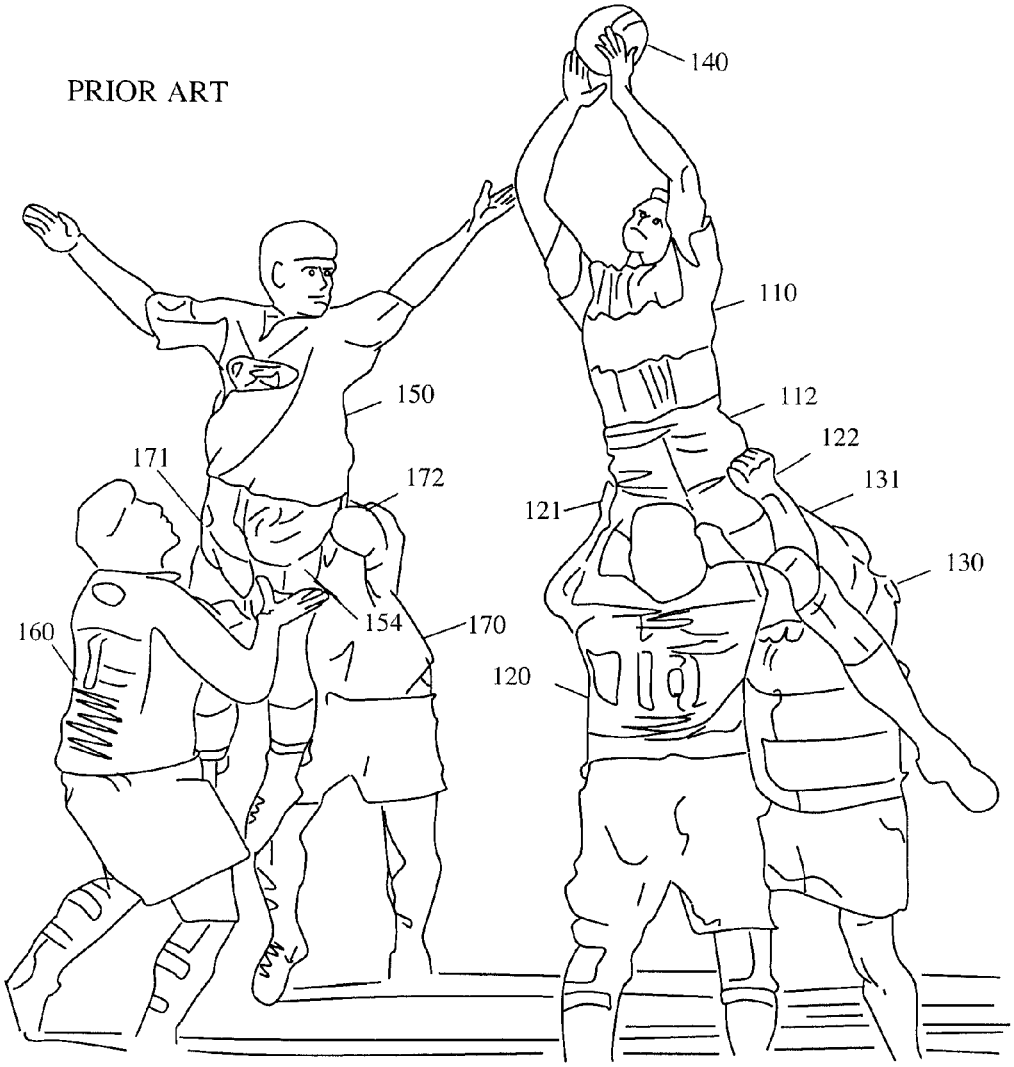
FIG. 1A and FIG. 1B show prior art techniques for lifting a jumper.

110 first jumper
112 shorts
120 first lifter
121 left hand of first lifter
122 right hand of first lifter
130 second lifter
131 left hand of second lifter
132 right hand of second lifter
140 ball
150 second jumper
154 thigh
160 third lifter
161 left hand of third lifter
162 right hand of third lifter
170 fourth lifter
171 right hand of fourth lifter
172 left hand of forth lifter
180 third jumper
190 underwrap
192(*a-b*) tape
194 bulge
700(*a-b*) leg glove or mitt
705 alternate leg glove
710 pocket attachment
715 base attachment
720 V attachment
730 fold
740 base layer
750 pocket
760 question mark attachment
770 conical attachment
780(*a-d*) edge
790(*a-b*) pocket opening
810 base strap
990 lower thigh
992 knee
994 calf

SPECIAL DEFINITIONS non-elastic strap—a substantially linearly non-elastic, flat strip or ribbon of flexible material used for securing or holding together, e.g. polypropylene or cotton webbing

DESCRIPTION OF THE INVENTION

The present invention comprises a leg glove or leg mitten comprising one or two pockets for the hands of a lifter, the pockets having downward diagonal facing pocket openings. When a person jumps, one or more other people can assist the jumper by putting their hands in the diagonal pockets. Such a lifter is able to lift the jumper higher, support the jumper while in the air, and safely lower the jumper to the ground. When the jumper is not jumping, the jumper is able to run or otherwise move without hindrance or discomfort.

FIG. 1A

FIG. 1A illustrates two conventional means of lifting. As shown on the right, a first jumper 110 is lifted by a first lifter 120 and a second lifter 130. As shown on the left, a second jumper 150 is lifted by a third lifter 160 and a fourth lifter 170.

A first conventional means for lifting (gripping the shorts) is shown on right. The first jumper 110 is lifted by his shorts 112. The first lifter 120 lifts using both his left hand 121 and his right hand 122 on the bottom front of the shorts 112. The second lifter 130 is gripping the shorts with his left hand 131 and his right hand 132 (not shown) to lift. These grips allow the first lifter 120 and second lifter 130 to lift first jumper 110 to a height where he can intercept the ball 140.

A second conventional means for lift (gripping the thigh) is shown on the left. The fourth lifter 170 is using a similar technique of lifting as the second lifter 130 and uses both his right hand 171 and his left hand 172. Third lifter 160 is lifting second jumper 150 by his thigh 154. Note that the second jumper 150 is unstable, is falling, and was unable to intercept the ball because of the bad lift.

Lifting by the shorts has many disadvantages including, for example, discomfort for the jumper, less than optimal lift performance, and difficult to obtain grip. It is also difficult to obtain a secure grip on a bare thigh (e.g. third lifter 160). As discussed above, the shorts slide up to the groin of the jumper, causing pain and potential injury, failing to lift the jumper to an optimum height, i.e. where the knees of the jumper are higher than the head of the lifter.

FIG. 1B

Figure 1B:
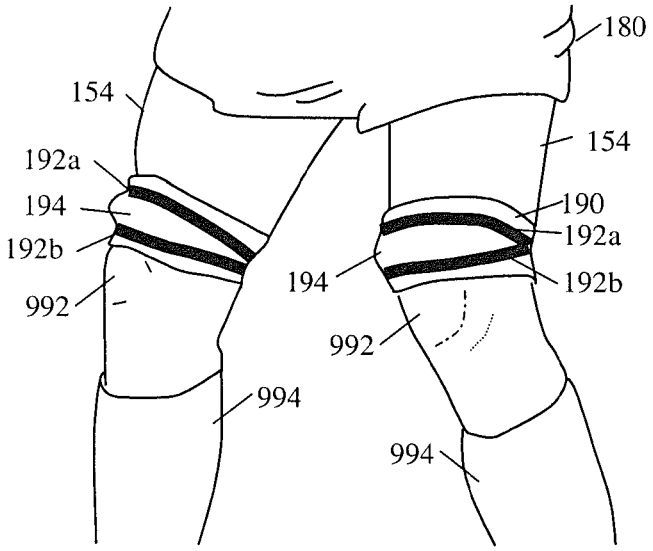

FIG. 1B illustrates a third jumper 180 with material wrapped around his thighs 154, just above each knee 992. The one-time-use material consists of an underwrap 190 covered by an upper strip of tape 192*a* and a lower strip of tape 192*b*. The underwrap 190 may consist of fabric athletic tape, foam tape, or cloth. Typically the tape is black, plastic, electrical tape. This arrangement creates a bulge 194. The bulge 194 may include additional layers of the underwrap 190 material.

Some players use hard plastic or foam to create the bulge 194; however these do not comply with the Laws of Rugby.

The one-time-use thigh wrap also has many disadvantages including, for example, difficulty in applying consistently, requiring application by coach, trainer, or other player during the critical pre-game preparation time, discomfort, waste of materials, and debris often left behind.

FIG. 2

Figure 2:
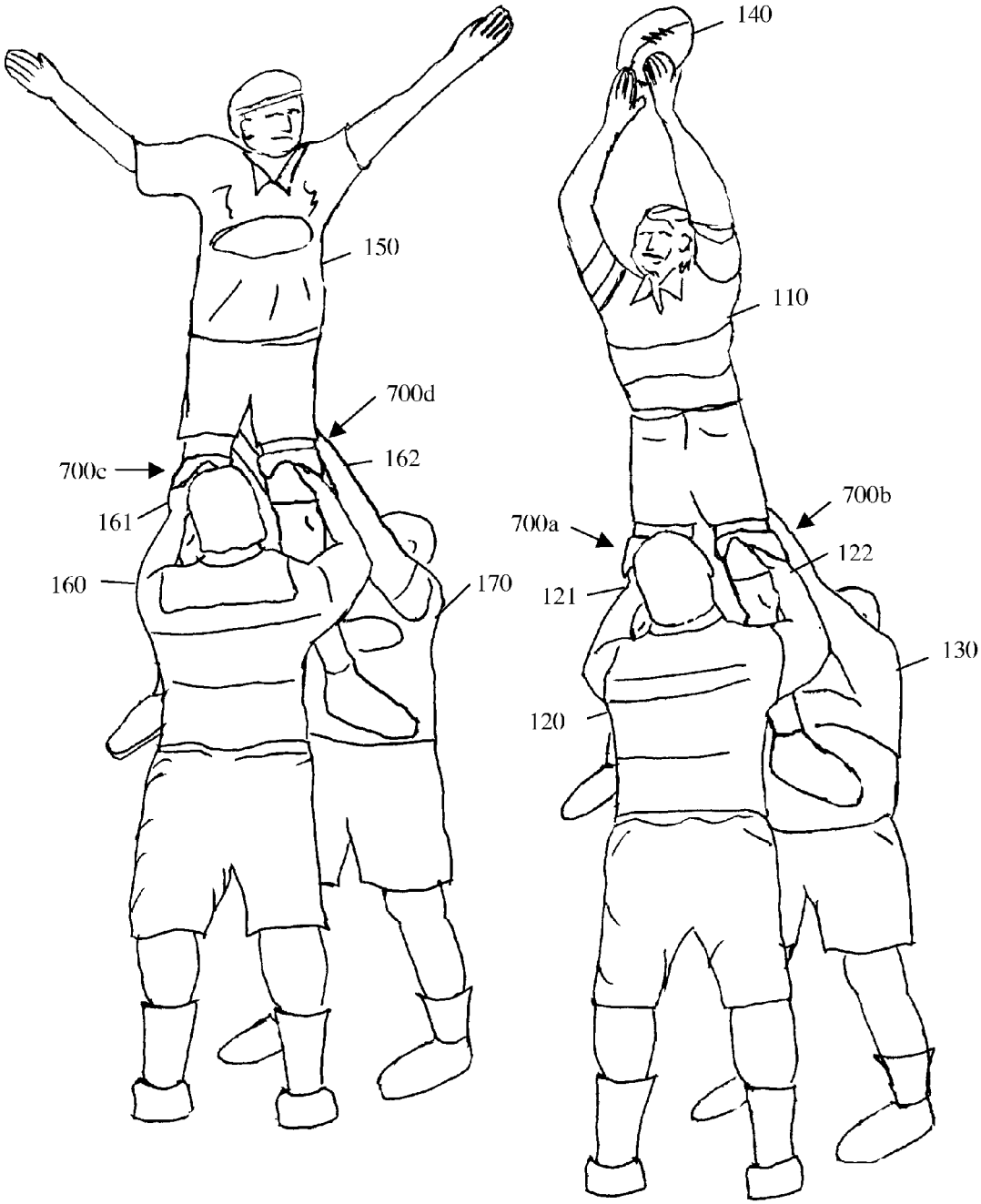
FIG. 2 shows the use of a leg glove.

FIG. 2 shows novel leg gloves, 700*a*, 700*b*, 700*c*, and 700*d*, respectively, being used to assist in jumping and lifting for the lineout. Each leg glove 700 comprises at least one diagonal pocket 750 configured to receive the hand (121, 122, 161, 162) of a lifter.

Prior to entering the game, each potential jumper (e.g. first jumper 110 and second jumper 150) applies one or more leg gloves 700 to one or more legs. When an opportunity to intercept the ball occurs, each jumper jumps. One or more players from the jumper's team are then able to insert their hands into the leg gloves 700. For example, as shown in FIG. 2, the first jumper 110 jumps during a lineout. The first lifter 120 places his hands (121 and 122) diagonally in the pockets 750 of each leg glove 700*a* and 700*b*, respectively. The second lifter 130 places his hands (131 and 132) on the back of the jumper's legs. Together, the first lifter 120 and the second lifter 130 are able to: a) lift the first jumper 110 to the full height of their extended arms, e.g. such that jumper's knees are higher than the lifters' heads, b) sustain the first jumper 110 at the height of the jump until the first jumper 110 is able to intercept the ball 140, and c) lower the first jumper 110 safely to the ground. Likewise, the third lifter 160 and the fourth lifter 170 are able to securely lift, sustain, and lower the second jumper 150 (shown wearing leg gloves 700*c* and 700*d*, respectively), who is able to have a more competitive and safe attempt at the ball 140.

Because the respective lifters can obtain a safe and secure grip on the leg gloves 700 of their respective jumper, both jumpers are able to: a) achieve a higher performance jump, b) be held stable during the jump, c) have a more consistent, more competitive attempt for the ball 140. The lifters are able to get a more consistent grip on the jumper. The jumper is able to jump with and be supported with less discomfort and more safety and confidence.

Compare the height and stability of the jumpers in FIG. 1A to FIG. 2 to see the increase in performance that may result from use of the present invention.

The increased safety and performance of various embodiments of the present invention allow lifters to support jumpers using the various embodiments.

Further, while the leg gloves 700 are shown as applied to Rugby, the leg gloves could be used in other sports that also require jumping, such as Volleyball (e.g. while spiking a set ball, etc.), Baseball (while jumping at the fence to stop a home run, etc.), Soccer (while jumping to receive a line out or to head the ball toward the goal), ice skating, or dance.

FIG. 3A Through FIG. 3D

Figure 3A:
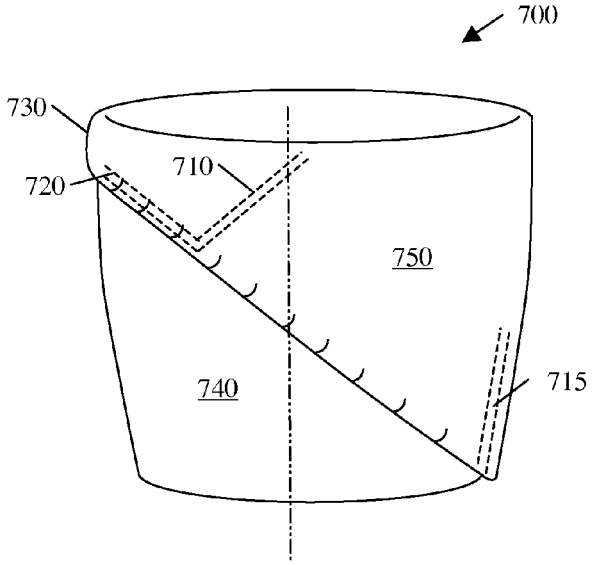
FIG. 3A through FIG. 3D illustrate leg glove or leg mitt embodiments.
Figure 3B:
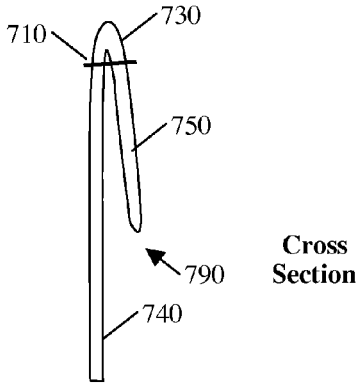
Figure 3C:
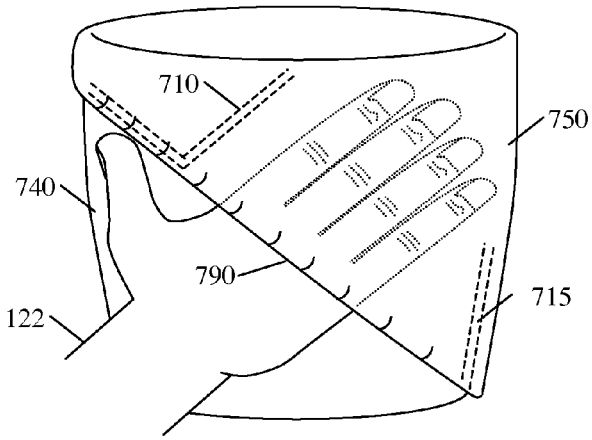

FIG. 3A through FIG. 3C illustrate an exemplary leg glove 700 (or leg mitt) embodiment.

As shown in FIG. 3A, and the cross section shown in FIG. 3B, the leg glove 700 is simply made from a single piece of flexible elastic material such as fabric or neoprene. Good results have been obtained by making the leg glove of elastic synthetic rubber (neoprene) sandwiched between thin layers of stretch nylon (spandex), having an actual thickness of two to two and one half millimeters. The fold 730 creates a base layer 740 and a partially overlapping pocket 750. The pocket 750 is secured with a pocket attachment 710 (shown sewn) and base attachment 715.

One advantage of using a flexible, elastic material is that the position of the leg glove may be adjusted to meet the needs of a specific condition, such as a particular play. Further, the leg glove can be quickly removed from one player and transferred to another player to accommodate substitutions.

The pocket attachment 710 is made by sewing with thread (as shown) and/or by gluing with an adhesive (not shown). Good results have been obtained by sewing with a wide zig-zag stitch (or similar stretch stitch). While the best results are obtained by sewing alone, Aquaseal brand (McNett Corporation) urethane repair adhesive and sealant has been found to be the best adhesive in embodiments that are glued, or sewn and glued.

The location of the pocket attachment 710 near to the top fold, as shown, creates a novel pocket 750. As shown in FIG. 3C, placing parts of the hand inside the pocket 750, formed in this manner, results in a superior, more secure grip than can be achieved by abutting a flat ridge such as shown, for example, in Giacheri. The pocket openings 790 are configured to face downward on a diagonal. The diagonal is about forty-five degrees. The diagonal pocket 750 is also easier to grasp, for example, when the jumper is already in the air.

For example, in Rugby, because it is not legal to bind with the jumper before the jump is started, the lifters must assess a location to grip while the jumper is in the air. Thus, using the leg glove, it is easier to place the open hands in the pockets 750 of the leg gloves 700 until the palms of the hands rest against the pocket attachment 710 (FIG. 3C). In this way the lifter can quickly assess the location of at least one of the pockets 750 and immediately apply lifting pressure from within the leg glove 700.

The diagonal orientation of the pocket allows the lifter to lift the jumper's knees above the lifter's head while allowing the hands and arms of the lifter to maintain a strong and comfortable position. The lifter is also able to lower the jumper to the ground while allowing the hands and arms of the lifter to maintain a strong and comfortable position. The diagonal orientation results in superior performance, comfort, and safety.

In this embodiment, the overlapping area above the pocket attachment 710 is attached with a V attachment 720 forming a shaped grip. This provides a V-shape designed to match the location of the extended thumb and extended index finger of the hand (e.g. 122 as shown in FIG. 3C). The shape is designed to more closely fit the shape of the hand while gripping the thighs. For example, the shape may be designed to match the edge of extended thumb and extended index finger of each hand (see also FIGS. 5C, 6A, and 6B).

Figure 6A:
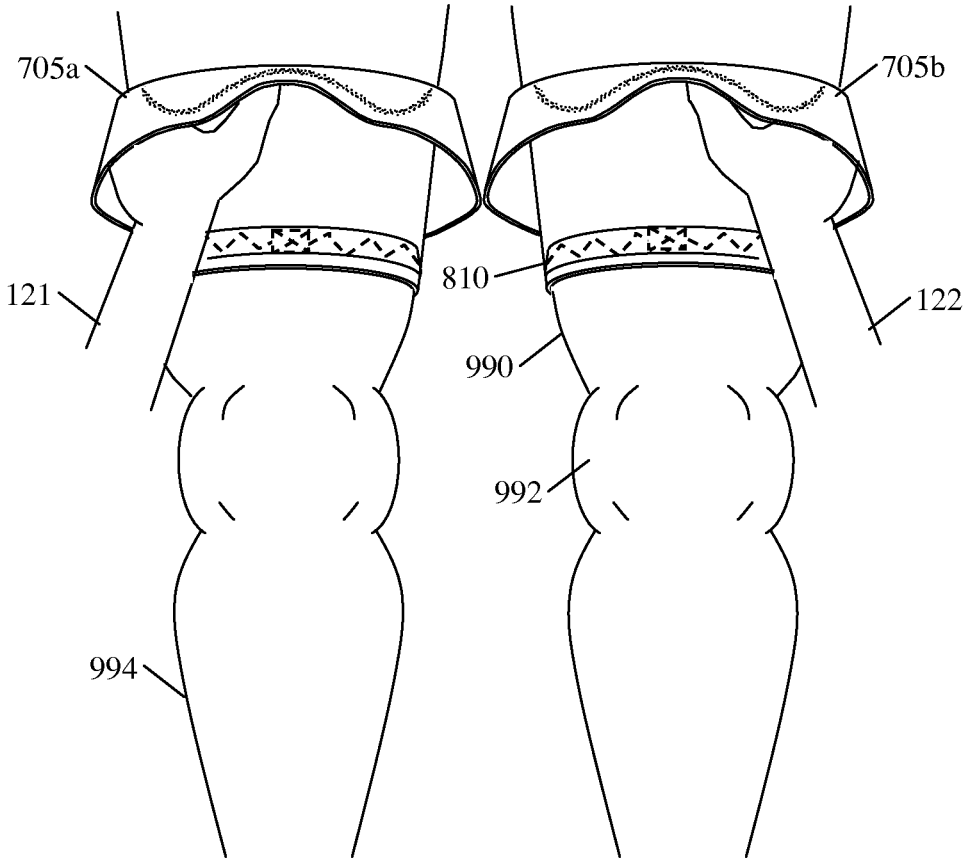
FIG. 6A show exemplary use of a leg glove on each leg.
Figure 6B:
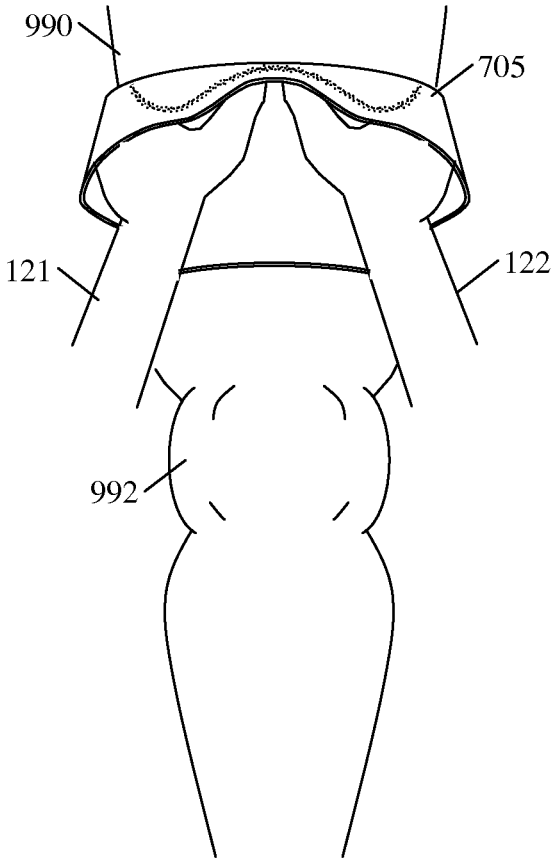
FIG. 6B show exemplary use of two hands in one leg glove.

The layout shown in FIG. 3C allows the reverse side to have a mirror image, second pocket 750 (not visible, but shown in FIGS. 4A, 4B, 6A and 6B). This allows one lifter to securely grasp one leg with both hands (e.g. 161 and 162), as shown in FIG. 6B and as poorly attempted by third lifter 160 in FIG. 1A, with greater success. Alternatively, the back lifter (e.g. fourth lifter 170) could put one hand (e.g. left hand of fourth lifter 172) in the second pocket 750, on the back, while the front lifter (e.g. third lifter 160) puts one hand (e.g. right hand of third lifter 162) in the front pocket 750.

The leg glove 700 (or leg mitt) embodiments provide improved, more secure grip. The hand (shown as 122) is easily slipped inside the pocket 750 during the lift and is easily removed as the jumper comes down. The downward diagonal facing pocket opening 790 is less likely to engage the hands or fingers of other players at other times, for example, while being tackled during open play.

Figure 3D:
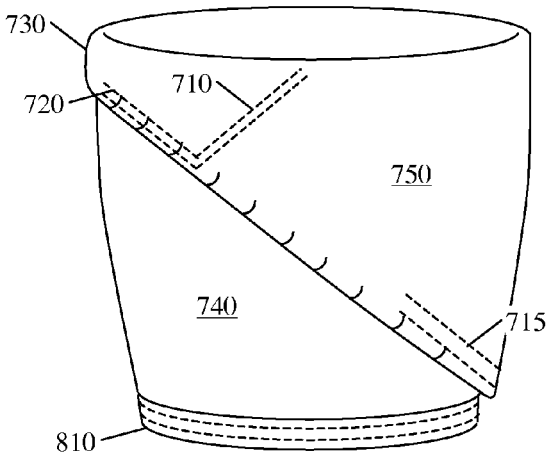

FIG. 3D shows another embodiment of a leg glove 700 with a base strap 810. Base strap 810 is made of non-elastic material of a fixed circumference, preventing excess sliding and movement of the leg glove 700 (or leg mitt) during lifting and open play.

The base strap 810 is a non-elastic, flat strip or ribbon of flexible material. The base strap 810 is of a fixed circumference such that the leg glove 700 can be passed over the calf 994 and knee 992 but stopped securely when it reaches the larger circumference of the lower thigh 990 (see, for example, FIG. 6A). Good results have been obtained when the leg glove is configured to stop about four inches above the cap of the knee 992, and base strap is about one or two inches in width. For high school and adult males, the base straps are about fifteen to eighteen inches. The base strap 810 encircles the leg of the jumper and prevents the leg glove from sliding up the thigh higher than about four inches above the knee. The base straps are permanently fixed in length. Good results have been obtained making different sized products for example, one size is configured to fit eighteen to twenty inch thighs, when the circumference is measured four inches above the cap of the knee 992, and another size is configured to fit twenty-two to twenty-four inch thighs. Other smaller sizes are made for smaller youth.

During the lift, the leg glove 700 could have over one hundred pounds of force applied to it. To prevent the base layer 740 material from tearing, and to more evenly distribute the force to the base strap 810 (and then to the jumper's leg), the pocket attachment 710 and the base attachment 715 are best sewn with wide and broad zig-zag stitching (shown for example in FIG. 4B), or a similar stretch stitch.

The novel, non-elastic base strap 810 overcomes a disadvantage found with conventional leg sleeves, such as Giacheri, that continue to stretch during the lift and slide up the leg because they are elastic. Further, the use of smaller circumference sleeves only partially addresses this problem and adds to the discomfort and constriction of leg between lifts.

Further, by attaching the base strap 810 to the base layer 740, it is more difficult for the opponents to use the base strap 810 disadvantageously.

Between lifts, it is preferable to keep the leg gloves on the legs of the jumper. When the leg glove 700 is properly sized, the elastic nature of the material will generally hold the leg glove 700 above the knee 992 without taping. If an extreme force is applied it can be slipped down to the ankle without adversely affecting the ability of the jumper to run and move about the field. The novel design reduces the chance of the jumper tripping by catching a cleat on the leg glove 700 in this situation. The leg gloves 700 can be easily repositioned during the break before the ball is thrown in on a line out.

Figure 4A:
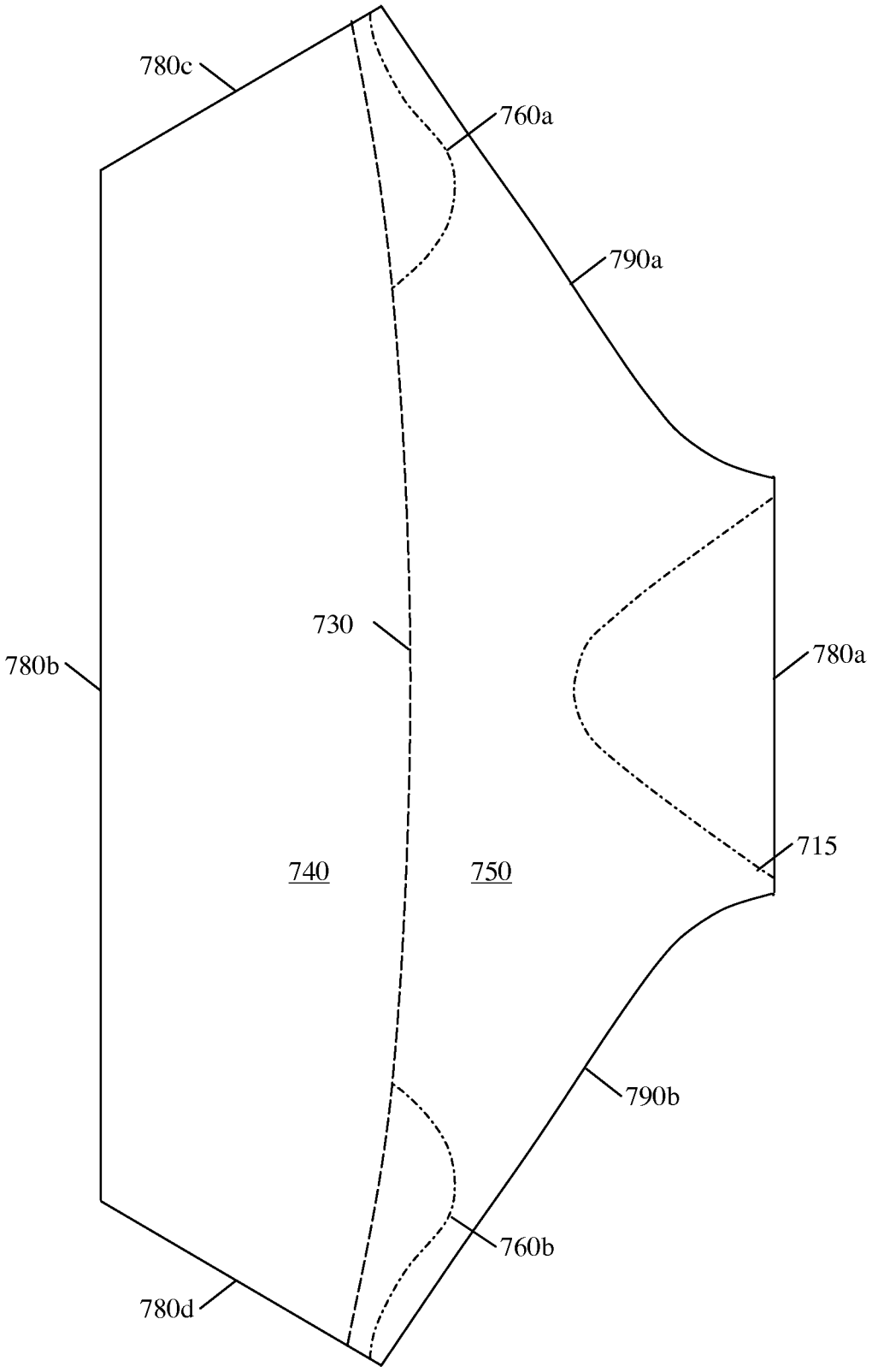
FIGS. 4A and 4B shows an alternate embodiment for a leg glove.
Figure 4B:
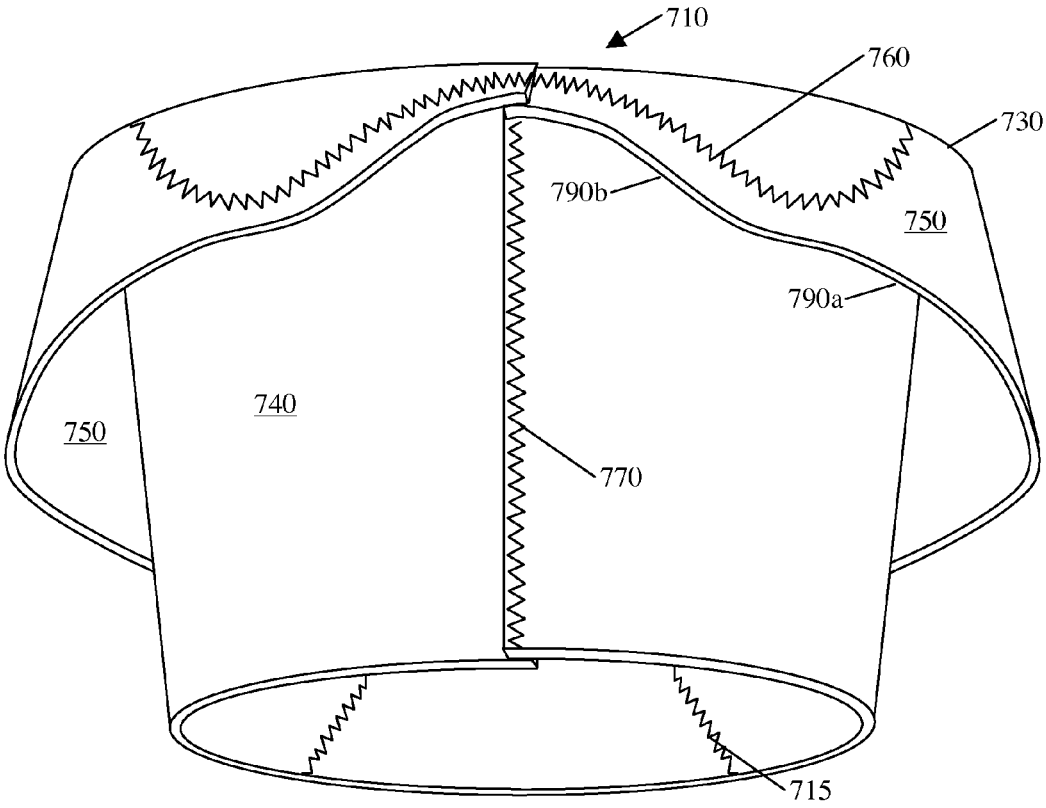

FIG. 4A and FIG. 4B

FIG. 4A and FIG. 4B illustrate a currently preferred embodiment of a leg glove 700 (or leg mitt), an alternate leg glove 705. Alternate leg glove 705 is simply made from a single piece of flexible, elastic material, such as neoprene, configured to a predetermined shape and size.

FIG. 4A shows a pattern view of the single piece of flexible, elastic material. FIG. 4B is a perspective view of the leg glove 705 after it is sewn in accordance with the method described below. Good results have been obtained by using synthetic rubber (neoprene) sandwiched between thin layers of stretch nylon (spandex). The pattern view of FIG. 4A shows four edges 780. A fold 730 creates a base layer 740 and a partially overlapping pocket 750. Edge 780*a* becomes the outside layer of the pocket 750 layer. Edge 780*b* becomes the inside base layer 740. In this embodiment, the fold 730 is not half way between edge 780*a* and 780*b*, but is closer to edge 780*b*, resulting in excess material in the pocket 750 layer, causing pocket openings 790*a* and 790*b* to naturally be held open when sewn as shown in FIG. 4B. When sewn, edge 780*a* is folded over and aligned with edge 780*b*, and permanently held together with base attachment 715. Next, edge 780*c* and 780*d* are brought together and sewn with conical attachment 770 (FIG. 7B), resulting in a conical section configured to fit the lower thigh 990 of the jumper. Next, the pocket 750 layer is secured with an embodiment of the pocket attachment 710, namely "question mark" attachment 760. The question mark attachment 760 is shown having two curves resembling a question mark and its minor image. As shown in FIGS. 4B, 5C, 6A, and 6B), the question mark attachment 760, forms two diagonal pocket openings, one pocket opening 790*a* which receives the fingers and palm of a lifter's hand, and a second pocket opening 790*b* which receives the thumb of the lifter's hand. The first pocket opening 790*a* is configured to be on about a forty-five degree angle diagonal. The diagonal of the second pocket opening 790*b* is configured to be about ninety degrees, or orthogonal, to the first diagonal.

In some embodiments the predetermined shape of the single piece of flexible, elastic material has the design claimed in U.S. Pat. No. D594,604.

FIG. 5A Through FIG. 5D

FIG. 5A through FIG. 5D illustrate alternate leg glove 705 embodiments.

Figure 5A:
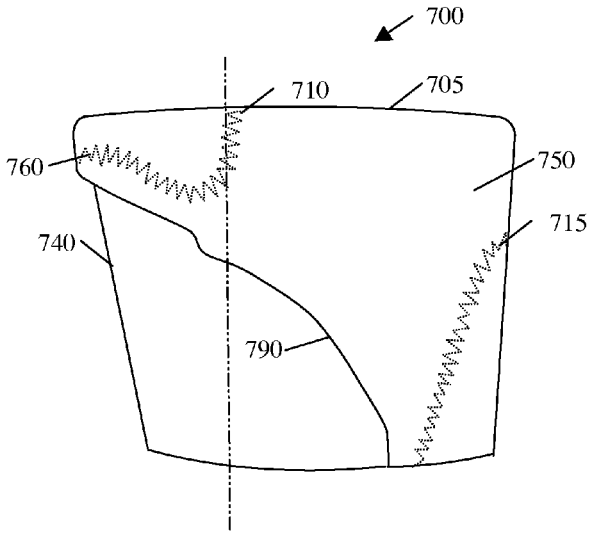
FIG. 5A through FIG. 5D illustrate the leg glove of FIG. 4B.
Figure 5B:
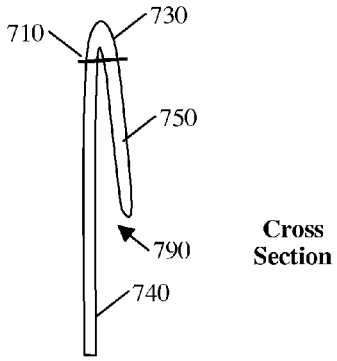
Figure 5C:
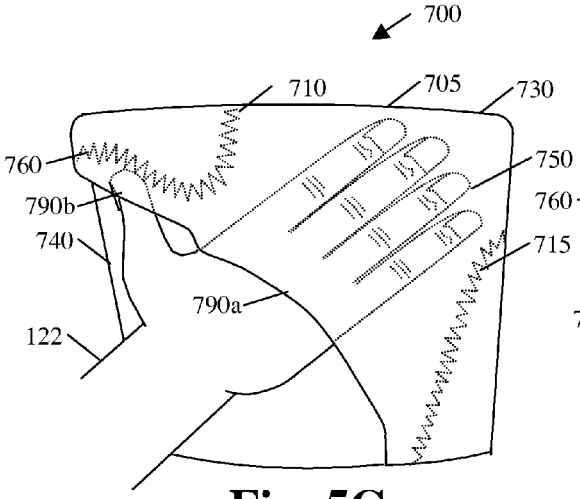

As shown in FIG. 5A, and the cross section shown in FIG. 5B, the leg glove 700 embodiment, alternate leg glove 705, is simply made from a single piece of flexible material such as fabric or neoprene. The location of the pocket attachment 710, shown in this embodiment as a question mark attachment 760, near to the top fold, as shown, creates a novel pocket 750. As shown in FIG. 5C, placing the fingers and palm inside the first pocket opening 790*a*, and placing the thumb inside the second pocket opening 790*b*, formed in this manner, results in a superior, more secure grip than can be achieved by abutting a flat ridge such as shown, for example, in Giacheri. The pocket openings 790 are configured to face downward on a diagonal. The diagonal is about forty-five degrees. The diagonal pocket 750 is also easier to grasp, for example, when the jumper is already in the air.

In this embodiment, the overlapping area above the pocket attachment 710 is attached with the question mark attachment 760 forming a lazy question mark shaped grip. This shape is designed to match the location of the extended thumb and extended index finger of the hand (e.g. 122 as shown in FIG. 5C). The shape is designed to more closely fit the shape of the hand while gripping the thighs. For example, the shape may be designed to match the edge of extended thumb and extended index finger of each hand (see also FIGS. 5C, 6A, and 6B). The question mark attachment 760 results in superior results over the V attachment 720, in the second pocket opening 790*b* allows the thumb to enter inside the pocket opening 790*b*. Further, the question mark attachment 760 distributes the forces more smoothly on the leg glove 705 and is less likely to tear when hundred pound forces are applied during a lift. Thus, it provides a better match for the hand and distributes the forces more evenly.

The layout shown in FIG. 5C allows the reverse side to have a mirror image, second pocket 750*c* (not visible, but shown in FIGS. 4A, 4B, 6A and 6B). This allows one lifter to securely grasp one leg with both hands (e.g. 161 and 162), as shown in FIG. 6B and as poorly attempted by third lifter 160 in FIG. 1A, with greater success. Alternatively, the back lifter (e.g. fourth lifter 170) could put one hand (e.g. left hand of fourth lifter 172) in the second pocket 750, on the back, while the front lifter (e.g. third lifter 160) puts one hand (e.g. right hand of third lifter 162) in the front pocket 750.

The alternate leg glove 705 embodiments provide improved, more secure grip. The hand (shown as 122) is easily slipped inside the pocket openings 790*a* and 790*b* during the lift and is easily removed as the jumper comes down. The downward diagonal facing pocket openings 790 are less likely to engage the hands or fingers of other players at other times, for example, while being tackled during open play.

Figure 5D:
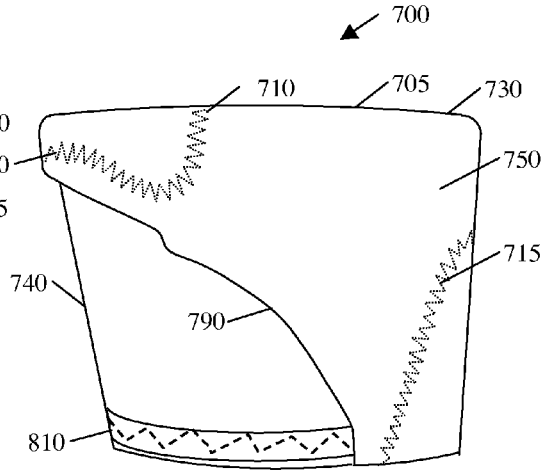

FIG. 5D shows another embodiment of an alternate leg glove 705 with a base strap 810. Base strap 810 is made of non-elastic material of a fixed circumference, preventing excess sliding and movement of the leg glove 700 (or leg mitt) during lifting and open play.

The base strap 810 is a non-elastic, flat strip or ribbon of flexible material. The base strap 810 is of a fixed circumference such that the leg glove 700 can be passed over the calf 994 and knee 992 but stopped securely when it reaches the larger circumference of the lower thigh 990 (see, for example, FIG. 6A). Good results have been obtained when the leg glove is configured to stop about four inches above the cap of the knee 992. For high school and adult males, the base straps are about fifteen to eighteen inches. The base strap 810 encircles the leg of the jumper and prevents the leg glove from sliding up the thigh higher than about four inches above the knee. The base straps are permanently fixed in length. Good results have been obtained making different sized products for example, one size is configured to fit eighteen to twenty inch thighs, when the circumference is measured four inches above the cap of the knee 992, and another size is configured to fit twenty-two to twenty-four inch thighs. Other smaller sizes are made for smaller youth.

During the lift, the leg glove 700 could have over one hundred pounds of force applied to it. To prevent tearing of the base layer 740 material, and to more evenly distribute the force to the base strap 810 (and then to the jumper's leg), the pocket attachment 710 (question mark attachment 760), the base attachment 715, and the conical attachment 707 are best sewn with wide and broad zig-zag stitching (shown for example in FIG. 4B).

The novel, non-elastic base strap 810 overcomes a disadvantage found with conventional leg sleeves, such as Giacheri, that continue to stretch during the lift and slide up the leg because they are elastic. Further, the use of smaller circumference sleeves only partially addresses this problem and adds to the discomfort and constriction of leg between lifts.

Further, by attaching the base strap 810 to the base layer 740, it is more difficult for the opponents to use the base strap 810 disadvantageously.

FIG. 6A and FIG. 6B

The novel structure allows the leg glove 700 to rapidly and easily attached over the thigh 154, without having to bend over to slide it over the foot, shoe, and calf. For example, the leg glove 700 could be carried in the jumper's pocket between jumps and quickly put only just before a jump. Alternatively, the leg strap could be thrown in from the sideline as needed or exchanged by players on a substitution.

FIG. 6A shows the general operation of leg gloves 700. In particular, the operation of alternate leg gloves 705(*a-b*) during a lift will be described. One leg glove 705 is placed above the knee 992 on the lower thigh 990. Preferably, the base strap 810 is sized to be placed about four inches above the knee 992. During the lift, the lifter (or lifters) places a hand in one or more diagonal pockets 750. The fingers of the hand enter the pocket opening 790 at a diagonal and the thumb enters a thumb pocket opening 790*b* (in the alternate leg glove 705) at a diagonal ninety degrees to the first diagonal (see thumb pocket opening 790*b* in FIG. 5C).

The pockets 750 are easily grasped before or during each jump or lift, and are easily released after the lift.

Leg Glove Methods

Method aspects of the present invention is now described. Using FIGS. 4A, 4B, and FIG. 5D as references, an exemplary method of making a leg glove is explained.

A first step is providing a single piece of flexible, elastic material, such as neoprene, configured to a predetermined shape and size.

For the embodiment shown in FIG. 5D, an optional second step is providing and attaching a base strap 810 comprising a non-elastic, flat strip or ribbon of flexible material. The length of the base strap 810 is preferably about two inches longer than the circumference of a lower thigh of a jumper.

In a novel embodiment of this base strap 810 attaching step, the single piece of flexible, elastic material is temporarily stretched to a predetermined size corresponding to the circumference of a lower thigh of a jumper, the non-elastic base strap 810 is placed over the temporarily stretched elastic material (e.g. base layer 740) and sewn with an appropriate stretch stitch as discussed above. After the base strap 810 is sewn to the temporarily stretched elastic material, the elastic material is released from the stretch allowing the base strap 810 to crinkle without any opening large enough for another players finger to enter.

A third step is folding the single piece of flexible, elastic material at fold 730 and aligning edge 780*a* with edge 780*b* such that a base layer 740 and a partially overlapping pocket 750 layer are formed, wherein diagonal pocket openings 790 are formed.

A fourth step is attaching the base layer 740 and the pocket 750 layer with a base attachment 715.

A fifth step is forming a conical shape by attaching the other edges with a conical attachment 770, wherein a conical shape is configured to match the shape of the lower thigh of the jumper.

For the embodiment shown in FIG. 5D, an optional sixth step is closing the base strap 810 into a permanently closed loop, having a circumference the same as the predetermined size.

Figure 7A:
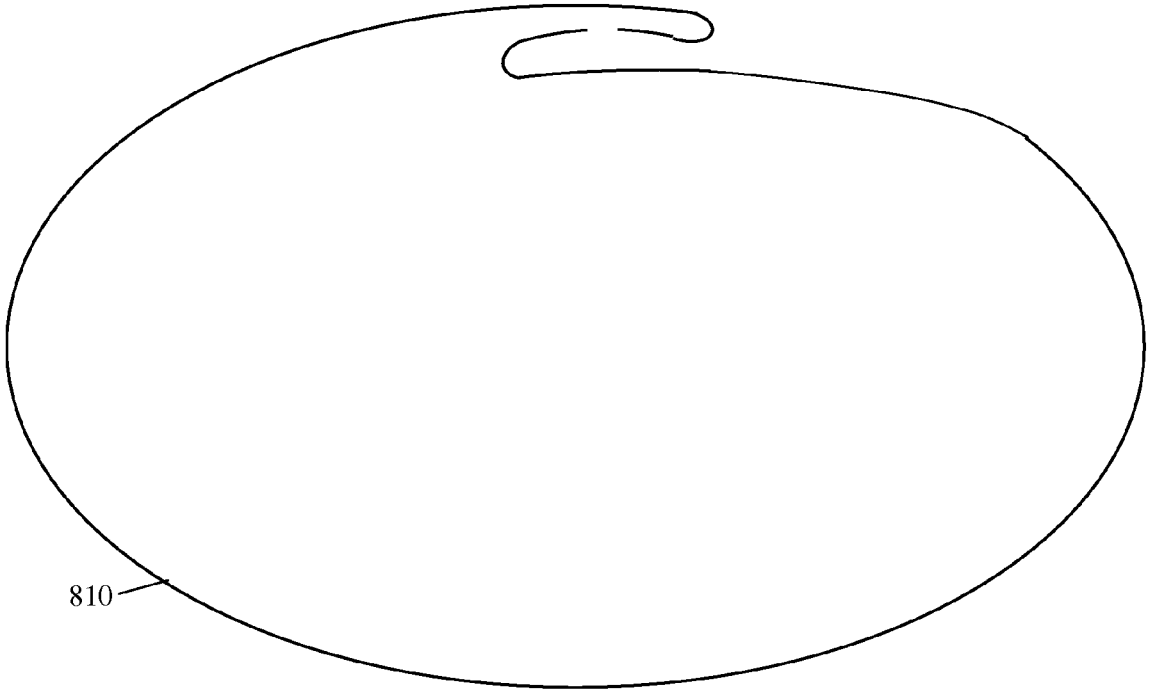
FIGS. 7A and 7B illustrate an exemplary method of closing the base strap in a permanent closed loop.
Figure 7B:
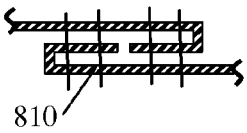

In a novel embodiment of this base strap 810 closing step, as shown in detail in FIGS. 7A and 7B, the ends of the base strap 810 are folded and overlapped such that the ends meet under a top layer and over a bottom layer. Preferable a box and X stitch is sewn over this arrangement (FIG. 7B) forming a strong, permanently closed loop. An advantage of the arrangement of FIGS. 7A and 7B is that the sharp and hard corner of a polypropolene strap which has been cut and sealed with a hot knife is covered by a layer of relatively soft polypropolene ribbon.

A seventh step is holding open the pocket openings by forming a pocket attachment 710. In the FIG. 3A embodiment, the pocket attachment 710 comprises a V attachment 720. In the FIG. 5A embodiment, pocket attachment 710 comprises a question mark attachment 760.

In some method embodiments the predetermined shape of the single piece of flexible, elastic material has the design claimed in U.S. Pat. No. D594,604.

Other Uses

While the descriptions of the various embodiments have been made in reference to Rugby Union, the present invention could also be used for other sports which involve, or in the future may involve, lifting, such as Volleyball, Association Football (soccer), International Rules Football, Australian Rules Football, Baseball, ice skating, dance, or other sports.

ADVANTAGES

Comfortable

Leg gloves offer comfort to the jumping player. The leg gloves do not apply pressure to the sensitive crotch areas of the body, as conventional methods of lifting do. The wearer also does not risk pulling out the hairs of the leg during removal, as in certain conventional methods.

Effective

Leg gloves are effective. A lifter has much better odds for obtaining and maintaining a sure grip with the leg gloves than with conventional methods. Thus, the jumper is more consistently able to obtain an optimum jump.

Safe

Because of the effectiveness of the leg gloves in allowing lifters to have a sure grip, the leg gloves offers greater safety and lessens risk of injury to both jumping and lifting players. Some embodiments also provide increased safety for other players, such as opponents.

Simple

Leg gloves are simple to make and use. A leg glove requires little time to put on.

Easy to Use

Leg gloves are easy to use. To install, the potential jumper simply applies, or pulls over, one leg glove over each leg. The lifters easily can find the diagonal pocket while lifting the jumper.

Unlike conventional methods of lifting, which require a second party such as a trainer or coach to apply and runs the risk of inconsistency, leg gloves are easily put on by one person and gives consistent results.

Leg gloves are easily removed or applied and thus may be exchanged between players during a game without removing shorts or boots.

Reusable

Leg gloves can be used over and over again. The conventional method of wraps and tapes can only be used once and a new one must be used for every game.

Because the conventional wraps and tapes can only be used once, the materials become trash after use. The remains of the wraps and tape are often strewn on the field and leave an unsightly, unprofessional appearance requiring extra effort to clean up.

Higher Performance

Leg gloves offer higher performance in jumping than conventional methods. The quality of grip maintained allows stronger and higher lift, for example during a Rugby lineout. Use of leg gloves gives teams more options on plays to be run during the lineout. The use of leg gloves does not hinder agility or running, as conventional taping sometimes does.

Quick

Leg gloves can be quickly applied and removed. Time from warm-up and pre-game training need not be taken to apply leg gloves. The conventional method of taping can take several minutes to apply and removal can also be a slow process. Conventional taping often requires assistance from a coach or other highly skilled person and detracts from the critical pre-game preparation.

Adjustable

Leg gloves can easily be switched from player to player to accommodate substitutions.

Empowering

Leg gloves can empower a single player to lift jumper when that player would not be able to otherwise do so. This can offer teams a considerable advantage in the lineout as well as the reception of kicks.

Efficient

The conventional method of taping is wasteful. Garbage is created after every game, and more taping and wrap materials need to be replaced and bought, adding to expenses. Leg gloves do not produce additional garbage or cost on repeated uses.

Better Appearance

Conventional methods of lifting worsen the look of players. Leg gloves have a smooth, professional look. While conventional taping has limited options, the leg gloves can easily be manufactured in a variety of colors to match the team color or the individual preference of the wearer. Space on the leg glove material may also be used to bear a team logo, national insignia, or advertising.

Can be Used with Compression Shorts

Some players elect to wear compression shorts while playing their sport. Conventional methods of taping are ineffective when used with compression shorts. Leg gloves enables players to wear compression shorts and in combination with the means for lifting.

Cost Effective

Because leg gloves can be made relatively inexpensively, are reusable, and eliminate waste the present invention is cost effective. In particular, the leg gloves embodiments can be made very inexpensively, providing a larger market and encouraging less waste.

Conclusion, Ramification, and Scope

Accordingly, the present invention provides an easy to use, simple, safe, comfortable, reusable, and effective means for lifting a jumper.

While the above descriptions contain several specifics these should not be construed as limitations on the scope of the invention, but rather as examples of some of the preferred embodiments thereof. Many other variations are possible. For example, different widths of strap could be used. Additionally, the leg gloves could be made of different materials or have additional features, or be used in different sports, without departing from the scope and spirit of the novel features of the present invention.

Accordingly, the scope of the invention should be determined not by the illustrated embodiments, but by the appended claims and their legal equivalents.

I claim:

1. A leg glove for wearing on a human thigh, comprising:

a single piece of flexible, elastic material having a predetermined shape and size, including a base portion formed into a generally conical section suitable for wearing on a human thigh and a pocket portion folded down over the base portion at a fold, the pocket portion attached to the base portion in at least two places separated from each other to form a downward-facing outside pocket between the base portion and the pocket portion of the material, the pocket forming a glove suitable for receiving four fingers and a palm of a human hand, wherein the pocket portion is attached with at least one seam formed in the shape of a question mark forming a first pocket opening for the fingers and palm and a second pocket opening suitable for receiving a thumb of the human hand.

2. The leg glove of claim 1, wherein the single piece of material has a long edge on the bottom sized to wrap around the thigh, two short edges each at the end of the long edge, the short edges permanently attached to each other thereby forming the single piece of material into the conical section, the excess material having a small portion at each short edge increasing to a tall portion away from the two edges, such that the tall portion is folded over and a first attachment is made near the bottom of the base portion.

3. The leg glove of claim 1, wherein the fold creates the pocket with a downward facing opening in a first diagonal direction.

4. The leg glove of claim 1, wherein the fold creates two mirror-image pockets with a downward facing opening in a first diagonal direction on either side of the base portion.

5. The leg glove of claim 1, further comprising:

a base strap of non-elastic, flexible material, permanently closed in a loop of fixed circumference and attached to the bottom of the conical section.

6. A leg glove for wearing on a human thigh, comprising:

a single piece of flexible, elastic material having a predetermined shape and size, including a base portion formed into a generally conical section suitable for wearing on a human thigh and a pocket portion folded down over the base portion, the pocket portion attached to the base portion in at least two places separated from each other to form a downward-facing outside pocket between the base portion and the pocket portion of the material, the pocket forming a glove suitable for receiving four fingers and a palm of a human hand; and a base strap of non-elastic, flexible material, permanently closed in a loop of fixed circumference and attached to the bottom of the conical section.

7. The leg glove of claim 6, wherein the single piece of material has a long edge on the bottom sized to wrap around the thigh, two short edges each at the end of the long edge, the short edges permanently attached to each other thereby forming the single piece of material into the conical section, the excess material having a small portion at each short edge increasing to a tall portion away from the two edges, such that the tall portion is folded over and a first attachment is made near the bottom of the base portion.

8. The leg glove of claim 6, wherein the downward-facing outside pocket has an opening in a first diagonal direction.

9. A leg glove for wearing on a human thigh, comprising:

a single piece of flexible, elastic material having a predetermined shape and size, including a base portion formed into a generally conical section suitable for wearing on a human thigh and a pocket portion folded down over the base portion at a fold, the pocket portion attached to the base portion in at least two places separated from each other to form a downward-facing outside pocket between the base portion and the pocket portion of the material, the pocket forming a glove suitable for receiving four fingers and a palm of a human hand, wherein the fold creates the pocket with a downward facing opening in a first diagonal direction, and wherein the pocket portion is attached to the base portion with a first seam and a second seam, each of the first and second seams spaced apart sufficiently to insert the four fingers and the palm therebetween and oriented substantially perpendicular to the first diagonal direction.

10. The leg glove of claim 9, wherein the first diagonal direction is about forty-five degrees relative to an axis of the thigh.

11. The leg glove of claim 9, wherein one of the first or second seams has a third seam connected thereto and oriented in the first diagonal direction so as to create a V shape between an extended index finger of the four fingers and an extended thumb of the human hand when receiving the four fingers and the palm.

12. The leg glove of claim 9, further comprising:

a base strap of non-elastic, flexible material, permanently closed in a loop of fixed circumference and attached to the bottom of the conical section.

* * * * *